US005655673A

United States Patent [19]

Weterrings et al.

[11] Patent Number: 5,655,673

[45] Date of Patent: Aug. 12, 1997

[54] LARGE SPICE JAR RACK

[75] Inventors: Frans M. Weterrings, Tuscumbia; E. Stanley Robbins, Killen, both of Ala.

[73] Assignee: Robbins Industries Inc., Florence, Ala.

[21] Appl. No.: 643,273

[22] Filed: May 3, 1996

[51] Int. Cl.[6] ..... A47B 73/00

[52] U.S. Cl. ..... 211/75; 211/74

[58] Field of Search ..... 211/75, 89, 65, 211/68, 74, 69

[56] References Cited

U.S. PATENT DOCUMENTS

| | | | |
|---|---|---|---|
| D. 156,729 | 1/1950 | Hampe et al. . | |
| D. 207,411 | 4/1967 | Diesinger . | |
| D. 252,429 | 7/1979 | Morin | D6/125 |
| D. 262,337 | 12/1981 | Bateman et al. | D6/114 |
| D. 273,162 | 3/1984 | Halverson | D6/125 |
| 658,042 | 9/1900 | Mendel | 211/74 X |
| 1,235,929 | 8/1917 | Hauck . | |
| 1,354,983 | 10/1920 | Lloyd . | |
| 1,389,984 | 9/1921 | Reed | 211/74 |
| 1,655,881 | 1/1928 | Steeves . | |
| 2,508,945 | 5/1950 | Heuer . | |
| 2,616,751 | 11/1952 | Goldenberg . | |
| 3,295,474 | 1/1967 | Ornstein | 108/152 |
| 3,946,877 | 3/1976 | Galicia | 211/65 |
| 4,049,126 | 9/1977 | Halverson | 248/220.41 X |
| 4,350,253 | 9/1982 | Rusteberg | 211/74 |
| 4,378,889 | 4/1983 | Lebowitz | 211/74 X |
| 4,637,580 | 1/1987 | Idstein | 248/220.21 X |
| 4,795,121 | 1/1989 | Comito | 211/89 X |
| 4,941,577 | 7/1990 | Ferree et al. | 211/89 X |
| 5,358,128 | 10/1994 | Belokin | 211/75 |
| 5,533,289 | 7/1996 | Hoffman | 40/544 |

*Primary Examiner*—Ramon O. Ramirez
*Assistant Examiner*—Sandra Snapp
*Attorney, Agent, or Firm*—Curtis Morris & Safford, P.C.; Gregor N. Neff

[57] ABSTRACT

A rack to hold cylindrical containers such as large spice jars has a plurality of pairs of resilient arms extending out from a back panel to form semi-cylindrical holders. Each holder has a pair of bridges filling the spaces between the rear of the semi-cylindrical holder and the back panel so as to strengthen the arms without adding to their thickness. Each holder has a plurality of inwardly-extending projections to catch under the lid of a jar to hold it even more securely.

9 Claims, 3 Drawing Sheets

LARGE SPICE JAR RACK

This invention relates to racks for holding cylindrical containers. More particularly, the invention relates to racks for use in holding relatively large jars of spices, condiments or small objects such as screws or other fasteners.

Various types of jar racks are available. Most jar racks known in the art are used for holding jars or cans which are relatively small. If a jar rack that can hold larger jars is desired (for example, jars approximately two inches in diameter), certain problems are created.

The applicant has recognized that increasing the capacity of such a device can make it difficult to secure the jars in place and prevent them from falling out of the rack, and can be unnecessarily expensive to make.

Accordingly, it is an object of the present invention to provide a jar rack which is particularly suited to solving the foregoing problems.

In particular, it is an object of the present invention to provide a jar rack with the capacity for holding relatively large jars securely in place and which is relatively inexpensive to make.

It is desired to provide such a jar rack which is a single molded part, and in which the thickness of all the wall sections in the molding are the same so as to decrease the molding time and the cost of manufacturing the device.

Another object is to provide such a jar rack which can be installed on a cabinet door or other surface but will not be flexed and loosened by the weight of the jars positioned in the rack.

It is a further object of the present invention to provide such a jar rack which will not be permanently deformed if a slightly oversized jar is inserted into the rack.

In accordance with the present invention, the foregoing objects are met by the provision of a jar rack which has a back panel and a plurality of clips projecting outwardly from the panel. Each clip includes a pair of opposed resilient arms which form a semi cylindrical holder for holding jars.

Each clip is fastened to the back panel by means of a pair of integral bridges which extend from the back panel to the side of the clip at a point where the bridge is tangent to the circle defined by the clip. The bridges reinforce the arms of the clips, and minimize unwanted flexing. They also make it possible to support and hold relatively heavy containers.

Several projections are provided along the inside perimeter of each clip. The cap of the jar, which typically protrudes outside the outer surface of the jar, rests on these projections so that the jar is held in place.

The rack may be installed on a surface via a strip of double-sided adhesive tape which is attached to the rear of the panel.

The foregoing and other objects and advantages will be set forth in or apparent from the following description and drawings.

Figure 1:
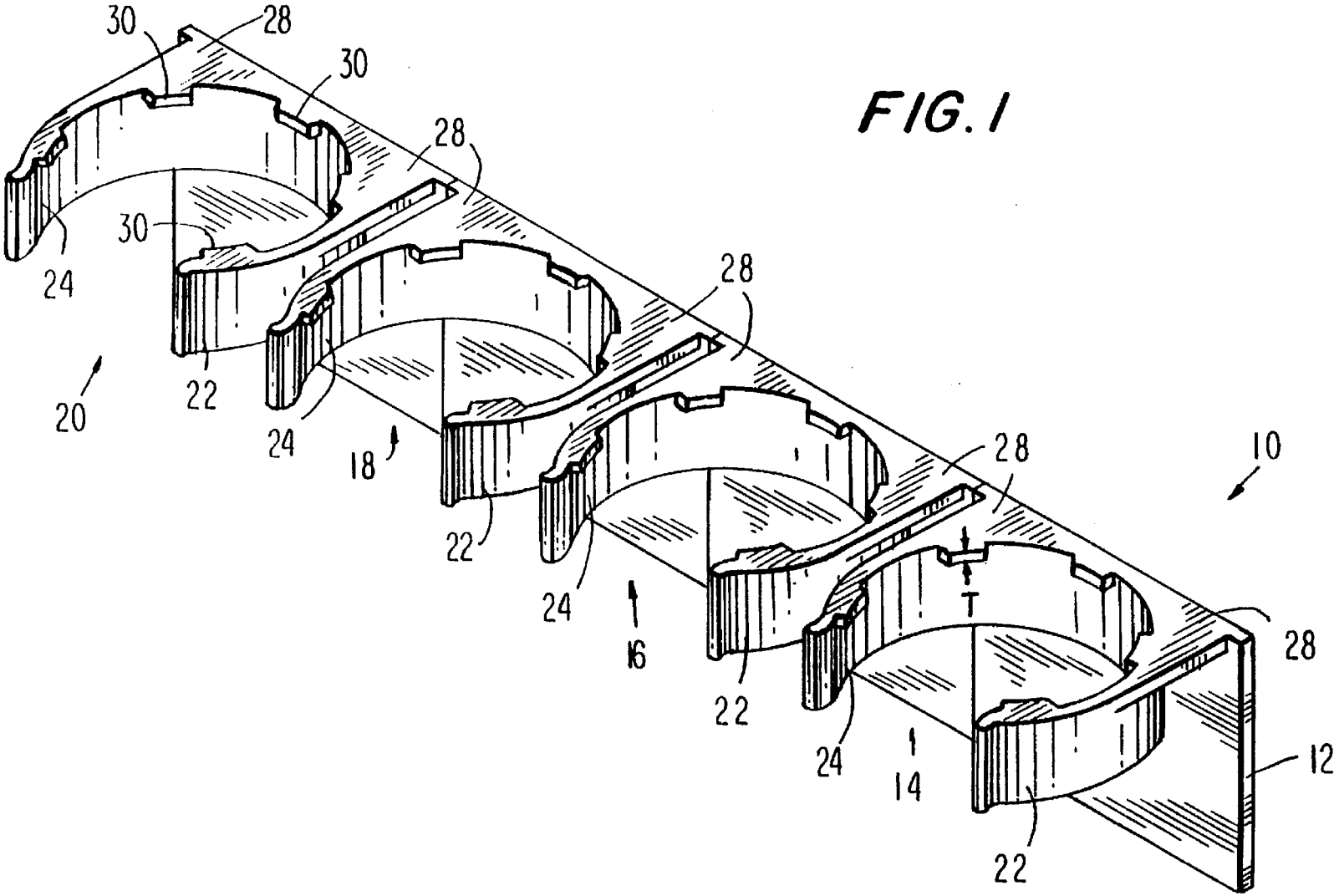
FIG. 1 is a top, front and right side perspective view of a rack constructed in accordance with the present invention.
Figure 2:
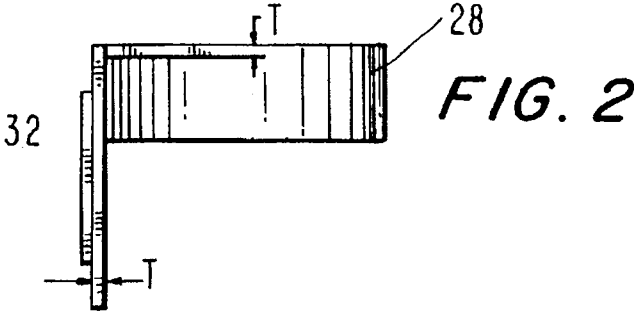
FIG. 2 is a side elevation view of the rack shown in FIG. 1.

FIG. 1 shows a rack 10 such as a jar rack constructed in accordance with the present invention. The jar rack 10 includes a back panel 12 with a plurality of clips 14, 16, 18, and 20 projecting outwardly from the panel 12.

Each clip includes a pair of opposed resilient arms 22 and 24 which form a semi-cylindrical holder into which each jar fits. A series of projections 30 is provided along the inside perimeter of the holder. Each jar typically has a metal screw cap whose edge protrudes slightly outside the cylindrical outer surface of the jar so that if the jar does not fit snugly in the clip, and it slides downwardly, the cap will catch on the projections 30 of the clip to hold the jar.

The jar rack is a single molded part.

Each clip is fastened to the back panel 12 by means of a pair of integral bridges 28 which bridges the gap which otherwise would exist between the rear portion of each clip and the back panel. Each of the bridges extends to the side of the clip at a point where it is tangent to the circle described by the clip.

Figure 3:
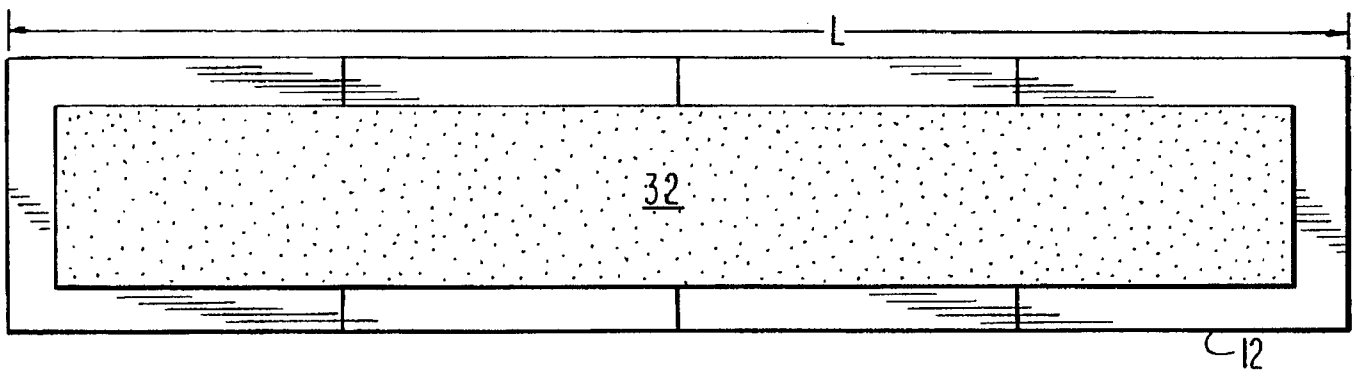
FIG. 3 is a rear view of the rack shown in FIG. 1.
Figure 4:
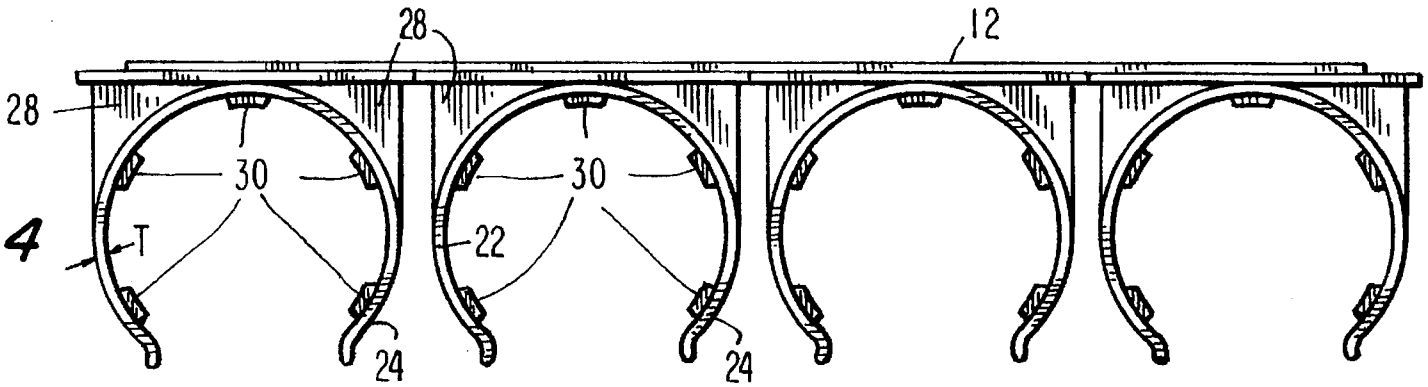
FIG. 4 is a bottom plan view of the rack shown in FIG. 1.

As shown in FIG. 3, a piece of double-sided adhesive tape 32 is attached to the rear of the panel 12. The customer installs the rack on a cabinet door 36 (FIG. 5) or other surface simply by peeling off the cover on the adhesive tape 32, and pressing it against the surface to attach it.

Figure 5:
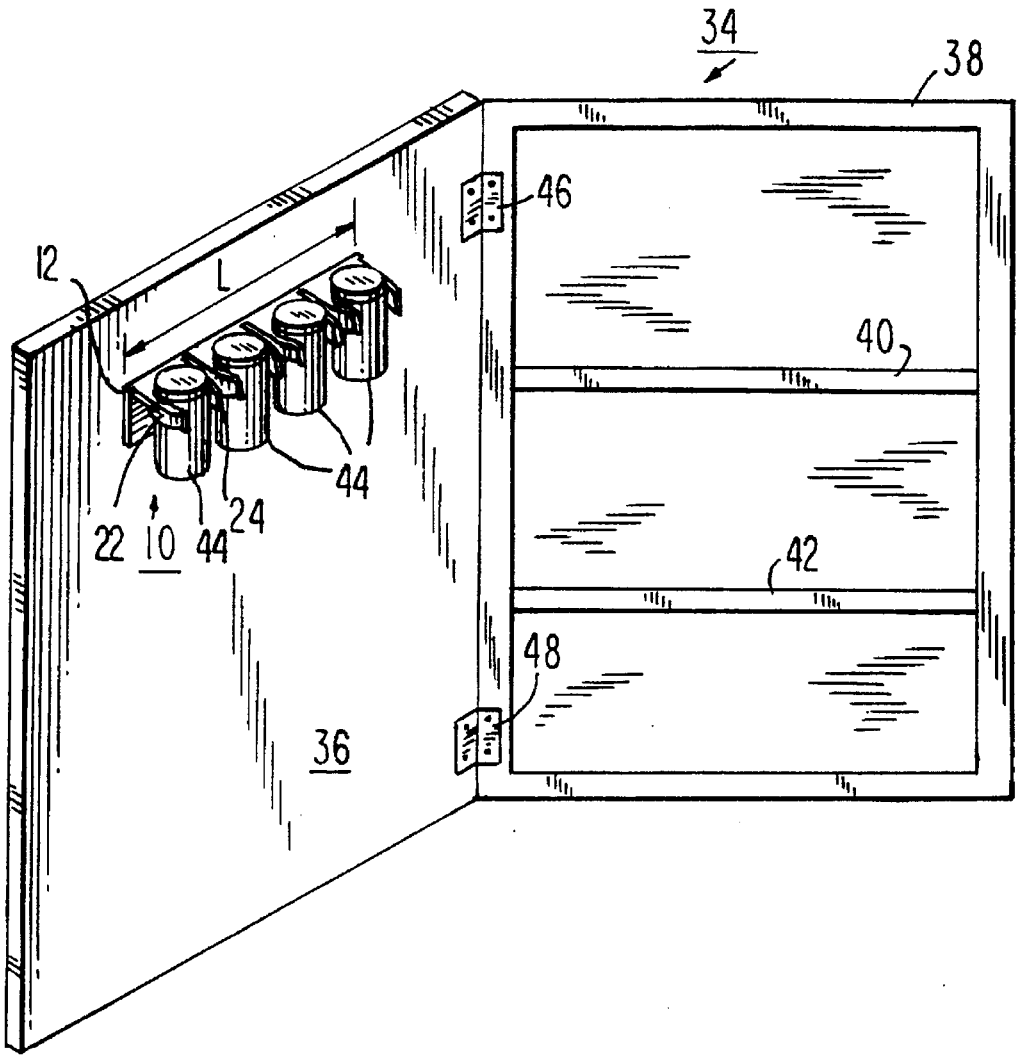
FIG. 5 is a perspective view showing the rack of FIG. 1 in use mounted on a kitchen cabinet door.

FIG. 5 shows the rack 10 secured to a hinged door 36 of a kitchen cabinet 34. The cabinet has a main housing 38 and shelves 40 and 42. When the cabinet door 36 is swung on its hinges 46 and 48 to open or close the cabinet, forces are applied to the jars 44 in the rack 10 which tend to dislodge them from their holders.

The present invention provides a rack which holds the jars securely despite the added forces.

The use of the bridges 28 has several different advantages. First, it greatly increases the grip of each of the clips so that it will more securely hold the jars in place and prevent them from flying out of the rack when the cabinet door, etc., is swung open or closed.

Although the same result might be obtained by making the material of the arms 22 and 24 thicker, this would be very undesirable because it is desired to make the thicknesses of all wall sections in the molding the same so as to decrease the molding time and the cost of manufacturing of the device.

Thus, the thickness T of the back panel 12, the bridges 28, the arms 22 and the projections 30 is approximately the same.

Furthermore, the bridges 28 minimize flexing of the back panel 12 under the weight of the jars positioned in the rack. This minimizes the chances that the adhesive tape on the back will be flexed and loosened and allow the rack to fall onto the floor.

The bridges 28 have a further advantage in that they prevent permanent deformation of the arms 22 and 24 when someone tries to insert a slightly oversized jar into one of the clips.

Advantageously, the rack 10 is molded out of high density polystyrene, which is very low in cost.

Preferably, the length L (FIGS. 3 and 5) of the back panel 12 is selected so that the jar rack will fit within the confines of a kitchen cabinet door. However, it can be made longer or shorter depending on the use to which it is put.

The above description of the invention is intended to be illustrative and not limiting. Various changes or modifications in the embodiments described may occur to those skilled in the art. These can be made without departing from the spirit or scope of the invention.

What I claim is:

1. A cylindrical container rack comprising, in combination, a back panel having at least one clip, said clip including a pair of opposed curved resilient arms which form a semi-cylindrical holder for gripping cylindrical containers, there being spaces between the rear portions of said arms and said back panel; said holder projecting outwardly from said back panel and being fastened to said back panel by a pair of integral bridges bridging said spaces between said rear portions of said arms and said back panel.

2. A device as in claim 1 in which each of said arms has a plurality of spaced apart projections along its inner perimeter.

3. A device as in claim 1 in which said rack is a single molded part, said bridges, said arms and said back panel all have approximately the same thickness.

4. A device in claim 1 in which the rear of said back panel has a strip of double-sided adhesive tape.

5. A jar rack comprising and integral molded structure consisting of a back panel, a plurality of pairs of curved resilient arms extending outwardly from said back panel, each of said pairs forming a semi-cylindrical jar holder, a bridge bridging the gap between the rear portion of each arm and said back panel, and a plurality of projections extending inwardly from said arms towards the center of each of said holders.

6. A rack as in claim 5 in which the thickness of the material of which said rack is molded is substantially uniform throughout said rack.

7. A rack as in claim 6 including a double-sided adhesive strip on the side of said panel away from said arms.

8. A rack as in claim 1, including a plurality of said clips extending outwardly from said back panel, in which each of said arms has a substantial dimension in a direction parallel to said back panel, each of said arms having an upper edge and a lower edge, each of said bridges being located adjacent said upper edge of one of said arms.

9. A rack as in claim 8, in which each of said arms has a plurality of projections on its inner periphery, each of said projections being located adjacent said upper edge of one of said arms.

* * * * *